US011830399B2

(12) United States Patent
Piao et al.

(10) Patent No.: US 11,830,399 B2
(45) Date of Patent: Nov. 28, 2023

(54) MULTI-CHANNEL VOLTAGE SENSING CIRCUIT FOR PIXEL COMPENSATION

(71) Applicant: LX Semicon Co., Ltd., Daejeon (KR)

(72) Inventors: Taiming Piao, Daejeon (KR); Won Kim, Daejeon (KR); Seong Geon Kim, Daejeon (KR); Young Ho Shin, Daejeon (KR); Byeon Cheol Lee, Daejeon (KR)

(73) Assignee: LX SEMICON CO., LTD., Daejeon (KR)

( * ) Notice: Subject to any disclaimer, the term of this patent is extended or adjusted under 35 U.S.C. 154(b) by 0 days.

(21) Appl. No.: 17/589,592

(22) Filed: Jan. 31, 2022

(65) Prior Publication Data

US 2022/0254289 A1 Aug. 11, 2022

(30) Foreign Application Priority Data

Feb. 5, 2021 (KR) ..... 10-2021-0017072

(51) Int. Cl.
*G09G 3/20* (2006.01)

(52) U.S. Cl.
CPC ..... *G09G 3/20* (2013.01); *G09G 2300/0413* (2013.01); *G09G 2310/0294* (2013.01)

(58) Field of Classification Search
CPC ..... G09G 3/20; G09G 2300/0413; G09G 2310/0294
See application file for complete search history.

(56) References Cited

U.S. PATENT DOCUMENTS

2014/0063023 A1* 3/2014 Baek ..... G09G 3/20 345/501
2014/0117863 A1* 5/2014 He ..... H05B 41/34 315/173
2017/0193928 A1* 7/2017 Deng ..... G09G 3/20
2017/0193972 A1* 7/2017 Gao ..... G09G 3/20
2018/0315389 A1* 11/2018 Hong ..... G11C 19/287
2019/0130813 A1* 5/2019 Fang ..... G09G 3/2092
2021/0201718 A1* 7/2021 Ha ..... G09G 3/32

* cited by examiner

*Primary Examiner* — Sejoon Ahn
(74) *Attorney, Agent, or Firm* — POLSINELLI PC

(57) ABSTRACT

A multi-channel voltage sensing circuit for pixel compensation includes a plurality of channel circuits arranged for multiple channels; and a first dummy channel circuit and a second dummy channel circuit disposed among the plurality of channel circuits with some channel circuits interposed therebetween, wherein the first dummy channel circuit and the second dummy channel circuit receive a first reference voltage of a fixed level, and provide electrical coupling to adjacent channel circuits.

18 Claims, 7 Drawing Sheets

MULTI-CHANNEL VOLTAGE SENSING CIRCUIT FOR PIXEL COMPENSATION

BACKGROUND

1. Technical Field

Various embodiments generally relate to compensating pixels of a display panel, and more particularly, to a multi-channel voltage sensing circuit for pixel compensation, which is improved so that multi-channel channel circuits for sensing pixel signals of a display panel have uniform sensing characteristics.

2. Related Art

A display system includes a display panel, a driver and a timing controller.

The driver converts digital display data, provided from the timing controller, into an analog source driving signal, and provides the source driving signal to the display panel. The driver is configured by one chip.

The number of drivers configured in the display system may be determined in consideration of the size and resolution of the display panel.

The display panel may be configured by an OLED panel. The OLED panel includes pixels which are configured by OLEDs. In this case, there may be deviations in electrical characteristics between the pixels of the display panel. The characteristic deviations should be corrected.

The display system should be configured to display a desired image by correcting the characteristic deviations between the pixels.

To this end, the driver may include a circuit for sensing pixel characteristics. Therefore, the driver may be configured to sense pixel characteristics by reading out pixel signals of the pixels, generate compensation data corresponding to the pixel signals and provide the compensation data to the timing controller.

The timing controller may have the function of providing display data which is obtained by compensating for the characteristic deviations between the pixels by using the compensation data of the driver.

Compensating the display data for the pixel characteristics by sensing the pixel signals as described above may be defined as panel compensation.

The driver includes internal circuits including a channel circuit, an amplifier circuit and an analog-to-digital converter. Each of the internal circuits may have its own gain and offset value, and the gain and offset value may vary for each channel processing a pixel signal.

The gain and offset value of each of the internal circuits of the driver may vary by a variation in a power supply voltage or a temperature.

Therefore, even the same pixel signal may be converted into different compensation data according to a difference in gain and offset value for each channel.

The driver may be configured to sense internal characteristics by the internal circuits, generate compensation data corresponding to the internal characteristics and provide the compensation data to the timing controller.

The timing controller may have the function of compensating the display data for the pixel characteristics by excluding the internal characteristics. Excluding the internal characteristics when compensating the display data for the pixel characteristics, by sensing the internal characteristics of the driver as described above, may be defined as internal compensation.

The driver may provide the compensation data for the internal compensation and the panel compensation at different timings, respectively, and the timing controller may compensate the display data by using the compensation data.

The driver has multiple channels for reading out the pixel signals, and is configured to include a channel circuit for each channel.

The driver may be configured to drive a different range of channel circuits depending on a channel mode. For the sake of illustration, it is assumed that the driver has 240 channels which read out pixel signals.

For example, the driver may be configured to operate in a channel mode selected between a first channel mode in which pixel signals are read out through the 240 channels, that is, all channels, and a second channel mode in which pixel signals are read out through some channels among the 240 channels.

In the case of the second channel mode, the driver may be configured such that some channel circuits, for example, 120 channel circuits, among the 240 channel circuits arranged in a line read out pixel signals. The remaining channel circuits may not read out pixel signals and may not be electrically connected to pixels of the display panel.

Channel circuits positioned at both ends of the 120 channel circuits which read out pixel signals and are arranged in a line are configured at adjacent positions where they can form electrical coupling relationships with the channel circuits which do not read out pixel signals. The channel circuits which do not read out pixel signals are in an electrically floated state.

Therefore, the channel circuits at both ends of the channel circuits which read out pixel signals and are arranged in a line are coupled with adjacent channel circuits which do not read out pixel signals and are in an electrically unstable state. Thus, the channel circuits at both ends are electrically coupled with the adjacent channel circuits which are in an electrically unstable state, and due to the influence thereof, may have internal offset values that are unstably changed. Accordingly, the channel circuits at both ends have a large difference in performance of sensing pixel signals from the other channel circuits which read out pixel signals and are arranged in a line.

Therefore, for the reason set forth above, it is difficult for the channel circuits of the driver forming the multiple channels to have uniform sensing characteristics, and as a result, it may be difficult to accurately perform compensation of the display data for the pixel characteristics.

SUMMARY

Various embodiments are directed to ensuring that multi-channel channel circuits may have uniform sensing characteristics and securing reliability in compensating display data for pixel characteristics.

In an embodiment, a multi-channel voltage sensing circuit for pixel compensation may include: a plurality of channel circuits arranged for multiple channels; and a first dummy channel circuit and a second dummy channel circuit disposed among the plurality of channel circuits with some channel circuits interposed therebetween, wherein the first dummy channel circuit and the second dummy channel circuit receive a first reference voltage of a fixed level, and provide electrical coupling to adjacent channel circuits.

In an embodiment, a multi-channel voltage sensing circuit for pixel compensation may include: a plurality of channel circuits arranged for multiple channels; and a dummy channel circuit disposed between the plurality of channel circuits, wherein the dummy channel circuit receives a first reference voltage of a fixed level, and provides electrical coupling to adjacent channel circuits.

The present disclosure is configured such that a dummy channel circuit is disposed between each of channel circuits whose readout is not selected and each of channel circuits whose readout is selected, among channel circuits.

Therefore, as channel circuits at both ends of the channel circuits whose readout is selected are electrically coupled to dummy channel circuits, the offset value of an internal circuit may be stabilized.

As a result, the channel circuits whose readout is selected may have uniform sensing characteristics, and reliability in compensating display data for pixel characteristics may be secured.

DETAILED DESCRIPTION

A display system may include a display panel, a driver and a timing controller.

Figure 1:
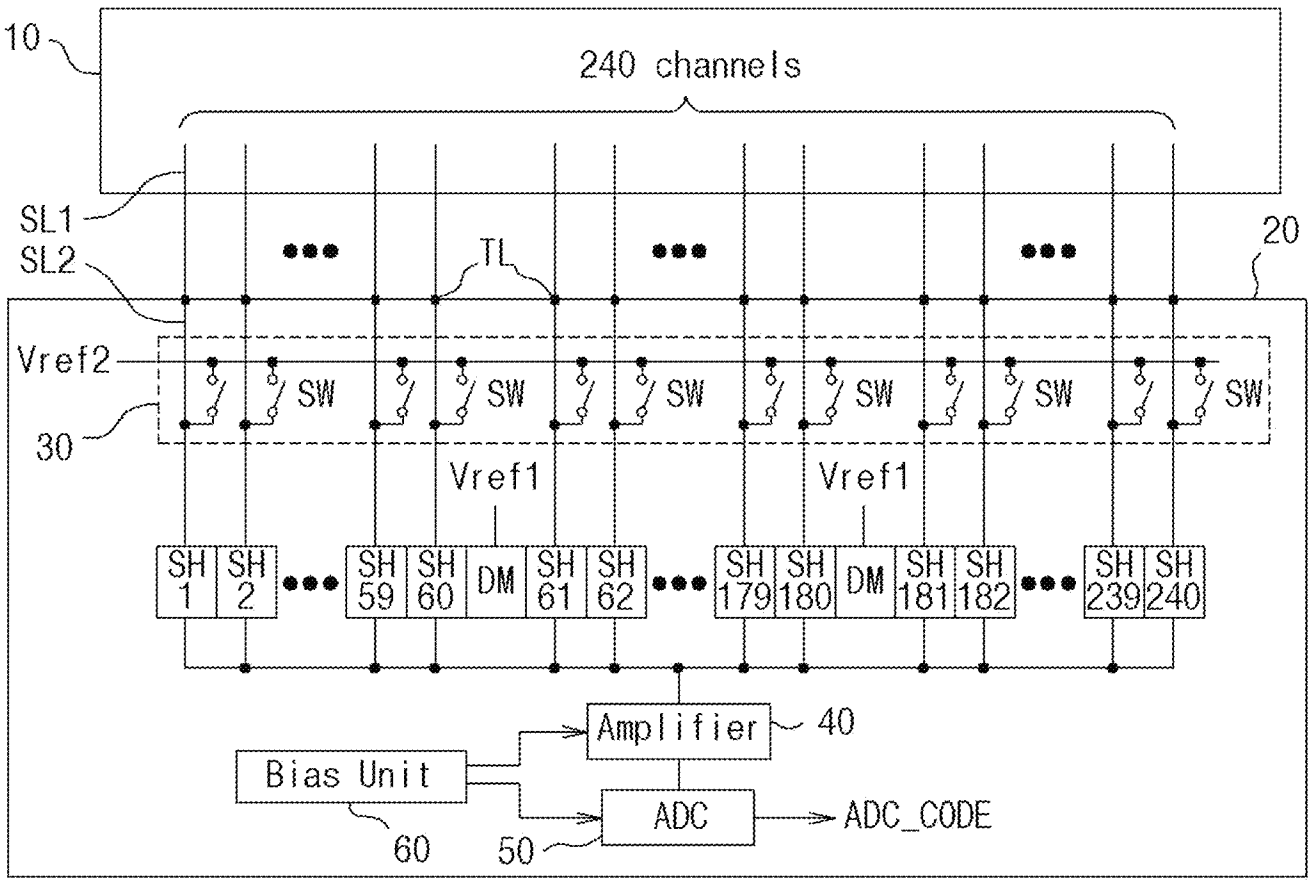
FIG. 1 is a circuit diagram illustrating a multi-channel voltage sensing circuit for pixel compensation in accordance with an embodiment of the present disclosure configured for a first channel mode.

FIG. 1 is a circuit diagram for explaining an embodiment of the present disclosure, and a display panel 10 and a driver 20 are illustrated in FIG. 1 for the explanation of the embodiment of the present disclosure.

The display panel 10 may be exemplified as a panel in which pixels (not illustrated) are configured by OLEDs. The pixels may be formed in a matrix structure on the display panel 10.

The driver 20 provides a source driving signal (not shown) to the display panel 10, and the pixels of the display panel 10 emit light in response to the source driving signal. An image to be expressed by display data may be displayed by the light emission of the pixels.

In the detailed description of the present disclosure, the illustration and description of a configuration in which the driver 20 provides the source driving signal to the display panel 10 and a detailed configuration inside the driver 20 therefor will be omitted.

Each of the pixels of the display panel 10 is configured to output a pixel signal corresponding to pixel characteristics through a sensing line SL1.

FIG. 1 illustrates that the display panel 10 has 240 channels for outputting pixel signals, and the pixel signals are outputted through sensing lines SL1 for multiple channels.

The display panel 10 is interfaced with the driver 20 to have the multiple channels for outputting the pixel signals. That is to say, it may be understood that the sensing lines SL1 of the display panel 10 are electrically connected to sensing lines SL2 of the driver 20 on a one-to-one basis.

The driver 20 has the sensing lines SL2 corresponding to the multiple channels, and is configured to read out the pixel signals through the sensing lines SL2, respectively. FIG. 1 illustrates that the sensing lines SL2 of the driver 20 are electrically connected to the sensing lines SL1 of the display panel 10 through the entirety of the 240 multiple channels on a one-to-one basis. As illustrated in FIG. 1, a mode in which the entirety of the 240 channels is configured to read out pixel signals may be defined as a first channel mode.

By the electrical connection between the sensing lines SL2 and the sensing lines SL1, the pixel signals of the display panel 10 may be provided to the driver 20.

The driver 20 is configured to read out pixel signals of the pixels through the multiple channels and generate and output compensation data ADC_CODE corresponding to the readout pixel signals.

A plurality of drivers 20 may be configured in one display panel 10. The number of drivers 20 configured in the display panel 10 may be determined according to the size and resolution of the display panel 10. For the sake of convenience in explanation, the embodiment of the present disclosure illustrates that one driver 20 is configured in the display panel 10.

The driver 20 may be fabricated as a semiconductor chip. For example, terminals TL for forming the multiple channels may be formed in a line on one side of the driver 20. It may be understood that the terminals TL are electrically connected to the sensing lines SL2 in the driver 20 on a one-to-one basis.

FIG. 1 illustrates that the driver 20 includes a selection circuit 30, a plurality of channel circuits SH1 to SH240, dummy channel circuits DM, an amplifier 40, an analog-to-digital converter 50 and a bias unit 60.

In the driver 20, the sensing lines SL2 are connected to the plurality of channel circuits SH1 to SH240 via the selection circuit 30.

The plurality of channel circuits SH1 to SH240 may be arranged in a line in parallel with the terminals TL which form the multiple channels. In other words, the plurality of channel circuits SH1 to SH240 may be formed to be arranged in lines with respect to the multiple channels and be adjacent to each other. Each of the plurality of channel circuits SH1 to SH240 is configured to read out the pixel signal of each of the pixels of the display panel 10 or receive a second reference voltage Vref2 of the selection circuit 30 through a corresponding sensing line SL2 and output a sensing voltage corresponding to the pixel signal or the second reference voltage Vref2.

In FIG. 1, The plurality of channel circuits SH1 to SH240 are configured to correspond one-to-one to a multi-channel.

However, this is only an example, and the plurality of channel circuits SH1 to SH240 are not limited to correspond one-to-one to multi-channels.

Each of the plurality of channel circuits SH1 to SH240 may be configured to include a sample and hold circuit which samples and holds the sensing voltage corresponding to the difference between an input and an internal reference voltage, and a detailed configuration thereof will be described later with reference to FIG. 3.

The driver 20 of FIG. 1 includes two dummy channel circuits DM. The two dummy channel circuits DM are configured at different positions of the plurality of channel circuits SH1 to SH240. As a more detailed example, the two dummy channel circuits DM are disposed among the plurality of channel circuits SH1 to SH240 with some channel circuits SH61 to SH180 interposed therebetween. Namely, one of the dummy channel circuits DM is disposed between the channel circuits SH60 and SH61, and the other of the dummy channel circuits DM is disposed between the channel circuits SH180 and SH181.

The dummy channel circuits DM may receive a first reference voltage Vref1 of a fixed level, and may provide electrical coupling to adjacent channel circuits. Unlike the plurality of channel circuits SH1 to SH240, each of the dummy channel circuits DM does not output a sensing voltage.

For example, each of the dummy channel circuits DM is configured to maintain a charging voltage corresponding to the first reference voltage Vref1. That is to say, each of the dummy channel circuits DM may provide electrical coupling by acting as a coupling capacitor which is charged in correspondence to the first reference voltage Vref1.

In more detail, each of the dummy channel circuits DM may be configured to charge a voltage corresponding to the difference between the first reference voltage Vref1 and a preset internal reference voltage. To this end, each of the dummy channel circuits DM may be configured to include a sample and hold circuit which samples and holds a sensing voltage corresponding to the difference between an input and the internal reference voltage, and a detailed configuration thereof will be described later with reference to FIG. 3.

The selection circuit 30 is configured to selectively provide the second reference voltage Vref2 to the sensing lines SL2. To this end, the selection circuit 30 is configured to include a plurality of switches SW which switch between the sensing lines SL2 and a voltage line providing the second reference voltage Vref2. The plurality of switches SW are configured to correspond to the sensing lines SL2 on a one-to-one basis. The turn-on and turn-off of the plurality of switches SW may be controlled simultaneously, sequentially or per group by a switching control signal (not shown). For example, the present disclosure will be described as the plurality of switches SW are sequentially turned on and off.

When the plurality of switches SW of the selection circuit 30 are sequentially turned on, the second reference voltage Vref2 is sequentially provided to the sensing lines SL2, and the second reference voltage Vref2 of the sensing lines SL2 is sequentially applied to the plurality of channel circuits SH1 to SH240. On the other hand, when the plurality of switches SW of the selection circuit 30 are turned off, the second reference voltage Vref2 is stopped from being provided to the plurality of channel circuits SH1 to SH240 through the sensing lines SL2.

The driver 20 of FIG. 1 includes the amplifier 40, the analog-to-digital converter 50 and the bias unit 60.

The amplifier 40 may be configured by a circuit which receives the sensing voltage outputted from each of the plurality of channel circuits SH1 to SH240, amplifies the sensing voltage and outputs an amplified voltage. Since the amplifier 40 may be variously designed according to a fabricator's intention to amplify the sensing voltage and output the amplified voltage, detailed illustration and description thereof will be omitted.

The analog-to-digital converter 50 is configured to output the digital compensation data ADC_CODE obtained by analog-to-digital converting the output of the amplifier 40. Since the analog-to-digital converter 50 may be designed to have various configurations for analog-to-digital converting the output of the amplifier 40 according to the fabricator's intention, detailed illustration and description thereof will be omitted. For example, the analog-to-digital converter 50 may be configured to integrate the inputted sensing voltage, convert a digital code corresponding to an integrated voltage into the compensation data ADC_CODE and output the compensation data ADC_CODE.

The bias unit 60 may be configured to provide bias voltages or bias currents necessary for the operations of the amplifier 40 and the analog-to-digital converter 50. Since the bias unit 60 may also be variously designed according to the fabricator's intention to provide the bias voltages or bias currents required by the amplifier 40 and the analog-to-digital converter 50, detailed illustration and description thereof will be omitted.

In the embodiment of FIG. 1 described above, a voltage sensing circuit may be understood as including the plurality of channel circuits SH1 to SH240 and the dummy channel circuits DM. Also, in the embodiment of FIG. 1, it may be understood that the voltage sensing circuit further includes at least one of the selection circuit 30, the amplifier 40 and the analog-to-digital converter 50.

The embodiment of FIG. 1 described above illustrates a configuration in the first channel mode in which pixel signals are read out through the 240 channels, that is, all channels.

For the first channel mode described above, all the 240 channels of the driver 20 are electrically connected to the sensing lines SL1 of the display panel 10, and the driver 20 reads out pixel signals through the 240 channels.

Figure 2:
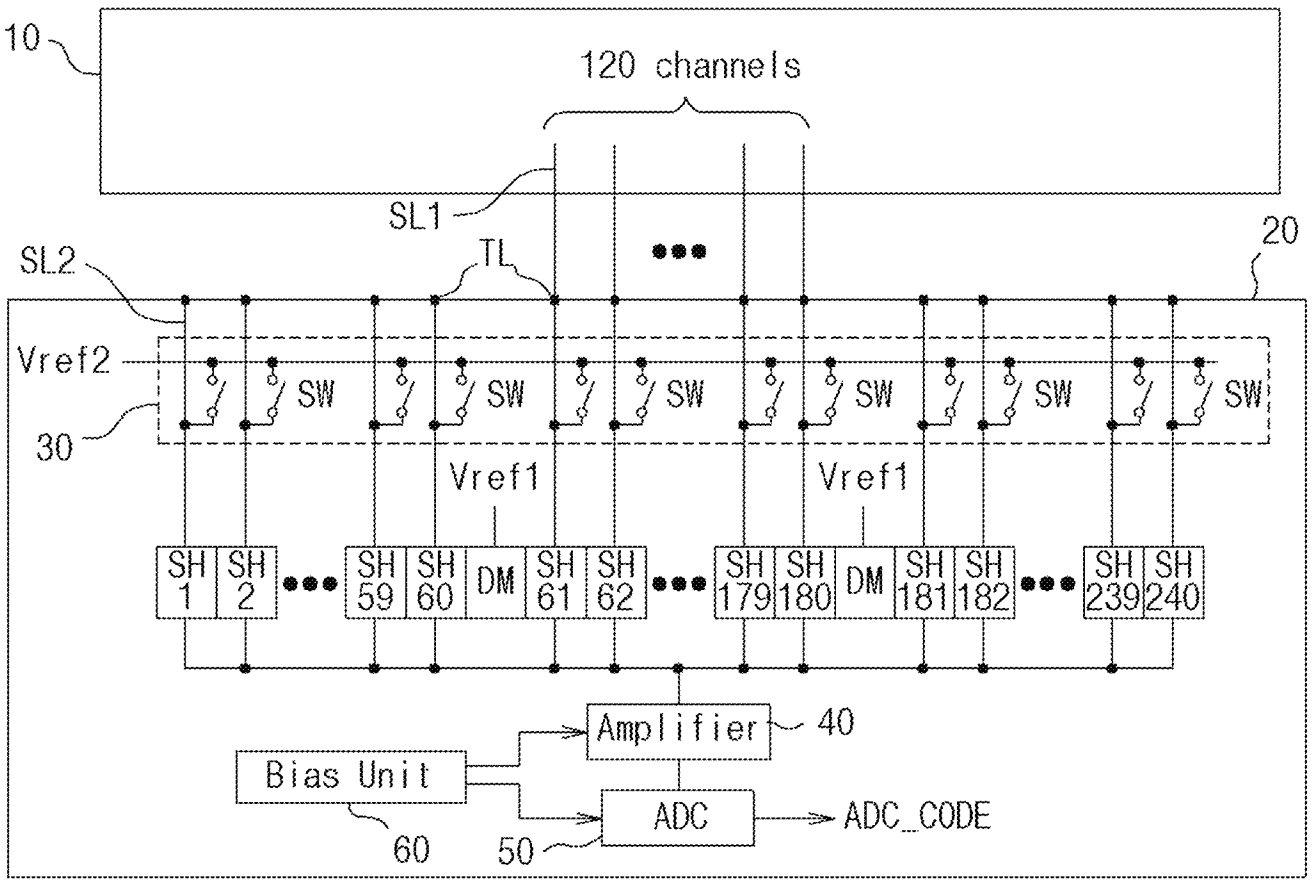
FIG. 2 is a circuit diagram illustrating the multi-channel voltage sensing circuit for pixel compensation in accordance with the embodiment of the present disclosure configured for a second channel mode.

Unlike this, the embodiment of the present disclosure may be configured as illustrated in FIG. 2 for a second channel mode. The second channel mode may be defined as a mode in which pixel signals are read out through some channels among the 240 channels.

FIG. 2 illustrates that the driver 20 is configured such that some channel circuits, for example, 120 channel circuits SH61 to SH180, among the 240 channel circuits SH1 to SH240 arranged in a line for the multiple channels read out pixel signals. The 120 channel circuits SH61 to SH180 whose readout is selected occupy a partial continuous region of a region in which the 240 channel circuits SH1 to SH240 are arranged in a line.

For the second channel mode described above, the 120 channel circuits SH61 to SH180 as some of the 240 channels of the driver 20 are electrically connected to the sensing lines SL1 of the display panel 10, and the driver 20 reads out pixel signals through 120 channels whose readout is selected. It may be understood that the interface between the display panel 10 and the driver 20 for the remaining channels whose readout is not selected is not formed.

FIG. 2 is different from FIG. 1 in terms of channel region to be interfaced between the display panel 10 and the driver 20, and the remaining configuration is the same. Therefore, description of the detailed configuration and operation of FIG. 2 will be omitted.

Figure 3:
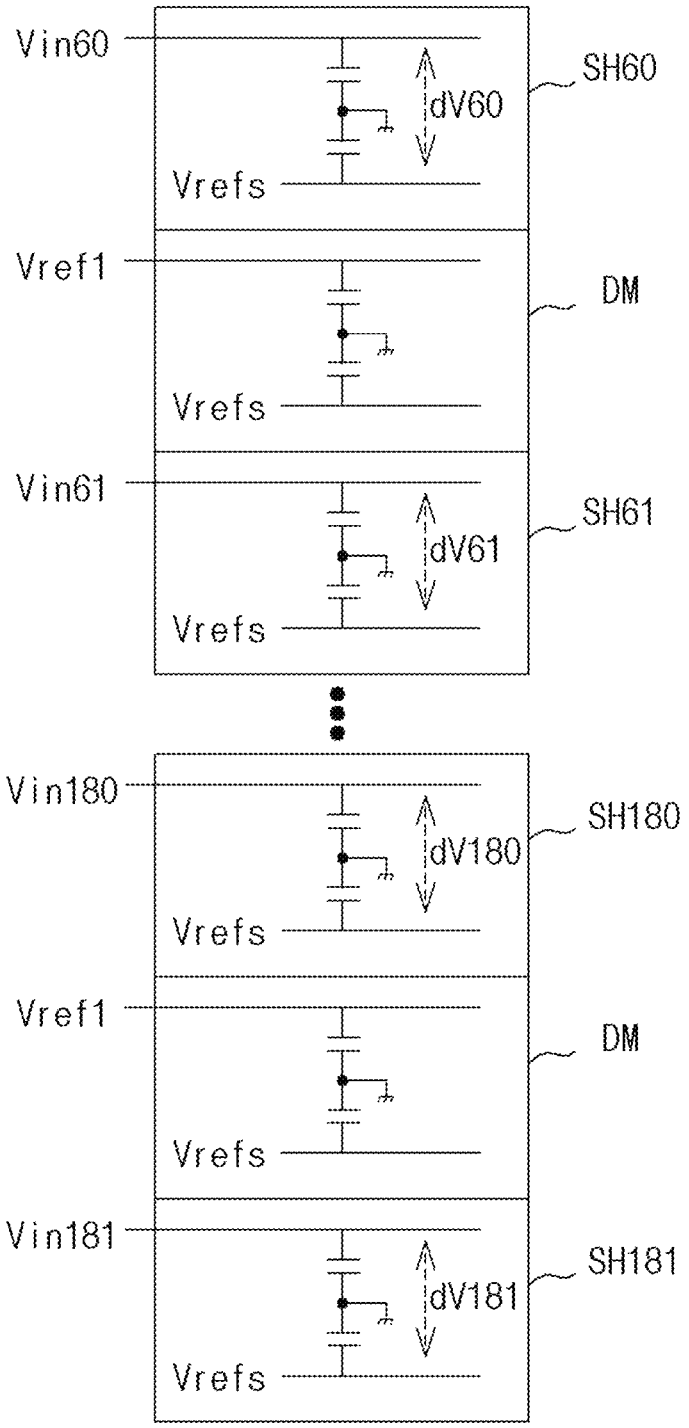
FIG. 3 is a detailed circuit diagram illustrating some of channel circuits.

The configurations of the plurality of channel circuits SH1 to SH240 and the dummy channel circuits DM configured in FIGS. 1 and 2 may be understood by referring to FIG. 3. FIG. 3 illustrates that the channel circuits SH60 to SH181 are arranged in a line in the region in which the plurality of channel circuits SH1 to SH240 are arranged in a line.

In FIG. 3, Vin60, Vin61, Vin180 and Vin181 denote pixel signals which are read out through the sensing lines SL2, Vrefs denotes an internal reference voltage, and dV60, dV61, dV180 and dV181 denote sensing voltages corresponding to differences between the pixel signals Vin60, Vin61, Vin180 and Vin181 and the internal reference voltage Vrefs.

The channel circuit SH60 includes a capacitor circuit having one end to which the preset internal reference voltage Vrefs is applied and the other end to which the read-out pixel signal Vin60 is applied. The capacitor circuit configured in the channel circuit SH60 is configured to charge and output the sensing voltage dV60 corresponding to the difference between the internal reference voltage Vrefs and the pixel signal Vin60.

In more detail, the capacitor circuit of the channel circuit SH60 includes a pair of capacitors which are connected in series through a ground node. Of the pair of capacitors, one capacitor is configured to form the one end of the capacitor circuit, be applied with the internal reference voltage Vrefs and be charged with a voltage corresponding to the internal reference voltage Vrefs, and the other capacitor is configured to form the other end of the capacitor circuit, be applied with the pixel signal Vin60 and be charged with a voltage corresponding to the pixel signal Vin60. By the above configuration, the capacitor circuit of the channel circuit SH60 may charge and output the sensing voltage dV60 corresponding to the difference between the voltages charged in the two capacitors.

Since the configurations and operations of the other channel circuits SH61, SH180 and SH181 may be understood by referring to the above-described channel circuit SH60, description thereof will be omitted.

The dummy channel circuit DM includes a capacitor circuit having one end to which the preset internal reference voltage Vrefs is applied and the other end to which the first reference voltage Vref1 is applied. The capacitor circuit configured in the dummy channel circuit DM is configured to store a charging voltage corresponding to the difference between the internal reference voltage Vrefs and the first reference voltage Vref1.

In more detail, the capacitor circuit of the dummy channel circuit DM includes a pair of capacitors which are connected in series through a ground node. Of the pair of capacitors, one capacitor is configured to form the one end of the capacitor circuit, be applied with the internal reference voltage Vrefs and be charged with a voltage corresponding to the internal reference voltage Vrefs, and the other capacitor is configured to form the other end of the capacitor circuit, be applied with the first reference voltage Vref1 and be charged with a voltage corresponding to the first reference voltage Vref1. In other words, it may be understood that the capacitor circuit of the dummy channel circuit DM stores a charging voltage corresponding to the difference between the voltages charged in the two capacitors.

In the above description, the first reference voltage Vref1 and the internal reference voltage Vrefs may be set to have the same level.

In the embodiment of the present disclosure, the driver 20 may be configured to output the compensation data ADC_CODE for internal compensation and then output the compensation data ADC_CODE for panel compensation.

For the internal compensation, the driver 20 is operated to use the second reference voltage Vref2, obtain a value to which the second reference voltage Vref2 is changed by the characteristics of internal circuits and output the compensation data ADC_CODE corresponding to the value.

When a mode for performing the internal compensation is defined as a first mode, the driver 20 sequentially provides the second reference voltage Vref2 of the same level to channels configuring multiple channels, and outputs the compensation data ADC_CODE determined by the characteristics of the internal circuits including the channel circuits corresponding to the respective channels, the amplifier 40 and the analog-to-digital converter 50.

To this end, in the first mode, the selection circuit 30 is sequentially turned on, and each of the plurality of channel circuits SH1 to SH240 receives the second reference voltage Vref2 through the sensing line SL2 and outputs a sensing voltage corresponding to the difference between the second reference voltage Vref2 and the internal reference voltage Vrefs. The sensing voltage may be outputted as the compensation data ADC_CODE through the amplifier 40 and the analog-to-digital converter 50.

For the panel compensation, the driver 20 is operated to read out a pixel signal and output the compensation data ADC_CODE corresponding to the pixel signal.

When a mode for performing the panel compensation is defined as a second mode, the driver 20 reads out pixel signals of channels configuring multiple channels and outputs the compensation data ADC_CODE corresponding to the pixel signals corresponding to the respective channels.

To this end, in the second mode, the selection circuit 30 is turned off, and each of the plurality of channel circuits SH1 to SH240 reads out a pixel signal through the sensing line SL2 and outputs a sensing voltage corresponding to the difference between the pixel signal and the internal reference voltage Vrefs. The sensing voltage may be outputted as the compensation data ADC_CODE through the amplifier 40 and the analog-to-digital converter 50.

The operation of the driver 20 for the internal compensation and the panel compensation described above may be applied in the same manner in the first channel mode of FIG. 1 and the second channel mode of FIG. 2.

Each of the plurality of channel circuits SH1 to SH240 of the driver 20 should read out a pixel signal and output a sensing voltage by the same offset value when performing operations for the internal compensation and the panel compensation. Further, the plurality of channel circuits SH1 to SH240 should have uniform sensing characteristics by maintaining uniform offset values.

Figure 4:
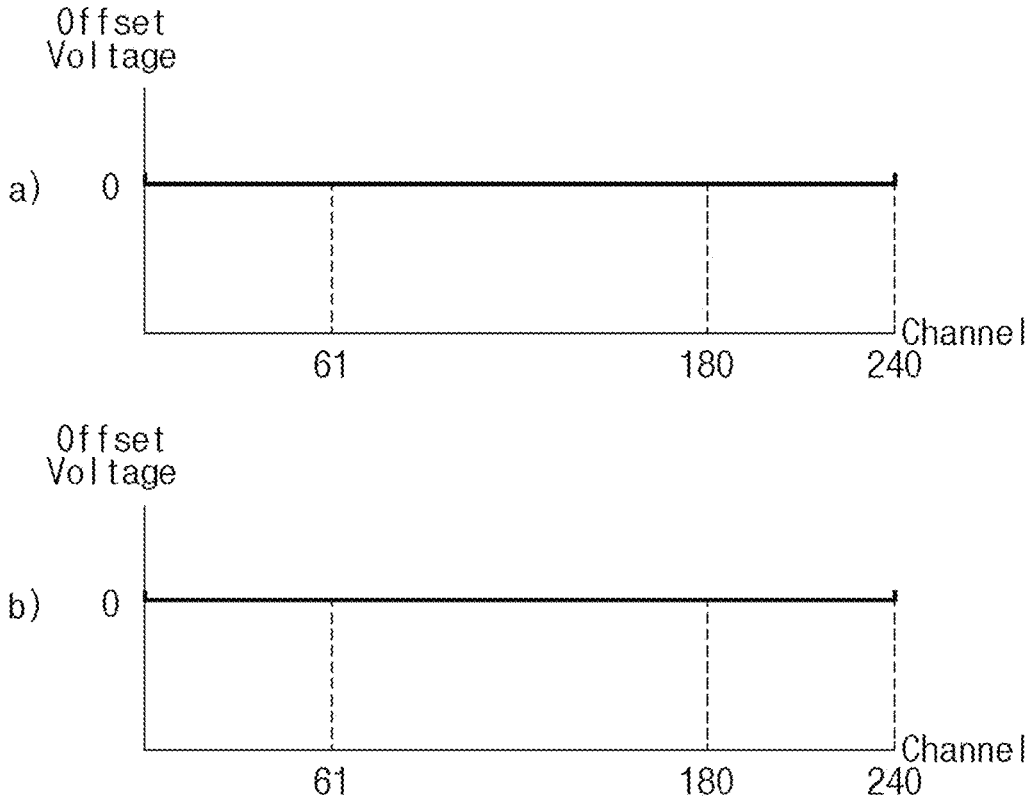
FIG. 4 is of graphs explaining the characteristics of offset values of a general voltage sensing circuit for the first channel mode.

FIG. 4 is of graphs explaining the characteristics of offset values of the plurality of channel circuits SH1 to SH240 when the dummy channel circuits DM are not configured and the display panel 10 and the driver 20 are interfaced to correspond to the first channel mode as illustrated in FIG. 1. In FIG. 4, a) corresponds to the internal compensation, and b) corresponds to the panel compensation.

When the display panel 10 and the driver 20 are interfaced in the first channel mode, as shown in a) and b) of FIG. 4, the plurality of channel circuits SH1 to SH240 maintain stable offset values (offset voltages). Namely, reliability on the compensation of pixel characteristics for display data may be secured.

Figure 5:
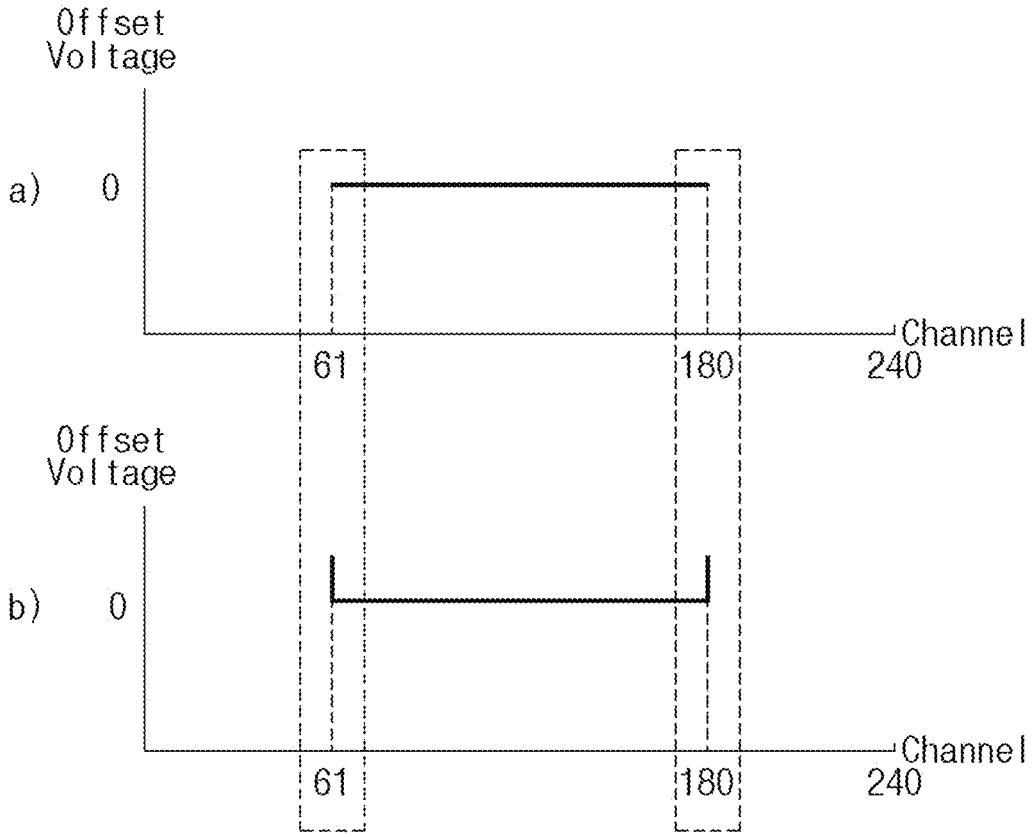
FIG. 5 is of graphs explaining the characteristics of offset values of the general voltage sensing circuit for the second channel mode.

FIG. 5 is of graphs explaining the characteristics of offset values of the plurality of channel circuits SH61 to SH180 when the dummy channel circuits DM are not configured and the display panel 10 and the driver 20 are interfaced to correspond to the second channel mode as illustrated in FIG. 2. In FIG. 5, a) corresponds to the internal compensation, and b) corresponds to the panel compensation.

When the display panel 10 and the driver 20 are interfaced in the second channel mode, as shown in a) of FIG. 5, the plurality of channel circuits SH61 to SH180 maintain stable offset values (offset voltages) for the internal compensation. However, for the panel compensation, as shown in b) of FIG. 5, the plurality of channel circuits SH61 to SH180 do not maintain uniform and stable offset values (offset voltages).

In more detail, the offset values of the channel circuits SH61 and SH180 positioned at both ends of the 120 channel circuits SH61 to SH180 which are arranged in a line to readout pixel signals have substantial differences from those of the other channel circuits SH62 to SH179. Therefore, the channel circuits SH61 and SH180 have substantial differences in performance for compensating for pixel characteristics from the other channel circuits SH62 to SH179, and as a result, it is difficult to secure reliability on the compensation of pixel characteristics for display data.

In the panel compensation with the dummy channel circuits DM not configured, the channel circuits SH61 and SH180 are configured at adjacent positions capable of forming electrical coupling relationships with other channel circuits SH60 and SH181 whose readout is not selected.

Therefore, the channel circuits SH61 and SH180 may be influenced by the electrically unstable states of the adjacent channel circuits SH60 and SH181 which do not read out pixel signals, and may have unstably changed internal offset values. That is to say, in the panel compensation, as shown in b) of FIG. 5, the channel circuits SH61 and SH180 have substantial differences in performance for compensating for pixel characteristics from the other channel circuits SH62 to SH179.

The present disclosure is implemented as described above to include the dummy channel circuits DM in order to stabilize the offset values of the channel circuits SH61 and SH180 positioned at both ends of the channel circuits SH61 to SH180 in the second channel mode.

Figure 6:
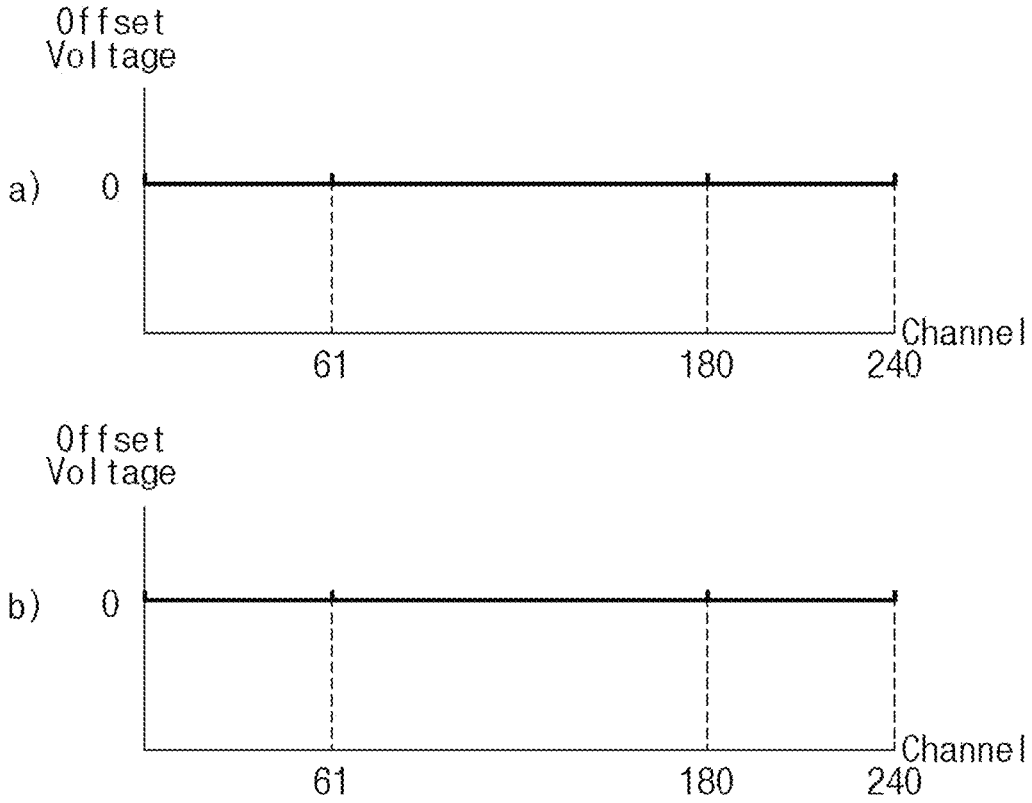
FIG. 6 is of graphs explaining the characteristics of offset values of the voltage sensing circuit in accordance with the embodiment of the present disclosure for the first channel mode.

FIG. 6 is of graphs explaining the characteristics of offset values of the plurality of channel circuits SH1 to SH240 when the dummy channel circuits DM are configured and the display panel 10 and the driver 20 are interfaced to correspond to the first channel mode as illustrated in FIG. 1. In FIG. 6, a) corresponds to the internal compensation, and b) corresponds to the panel compensation.

When the display panel 10 and the driver 20 are interfaced in the first channel mode as illustrated in FIG. 1, as shown in a) and b) of FIG. 6, the plurality of channel circuits SH1 to SH240 maintain stable offset values (offset voltages) in both the internal compensation and the panel compensation. Namely, reliability on the compensation of pixel characteristics for display data may be secured.

Figure 7:
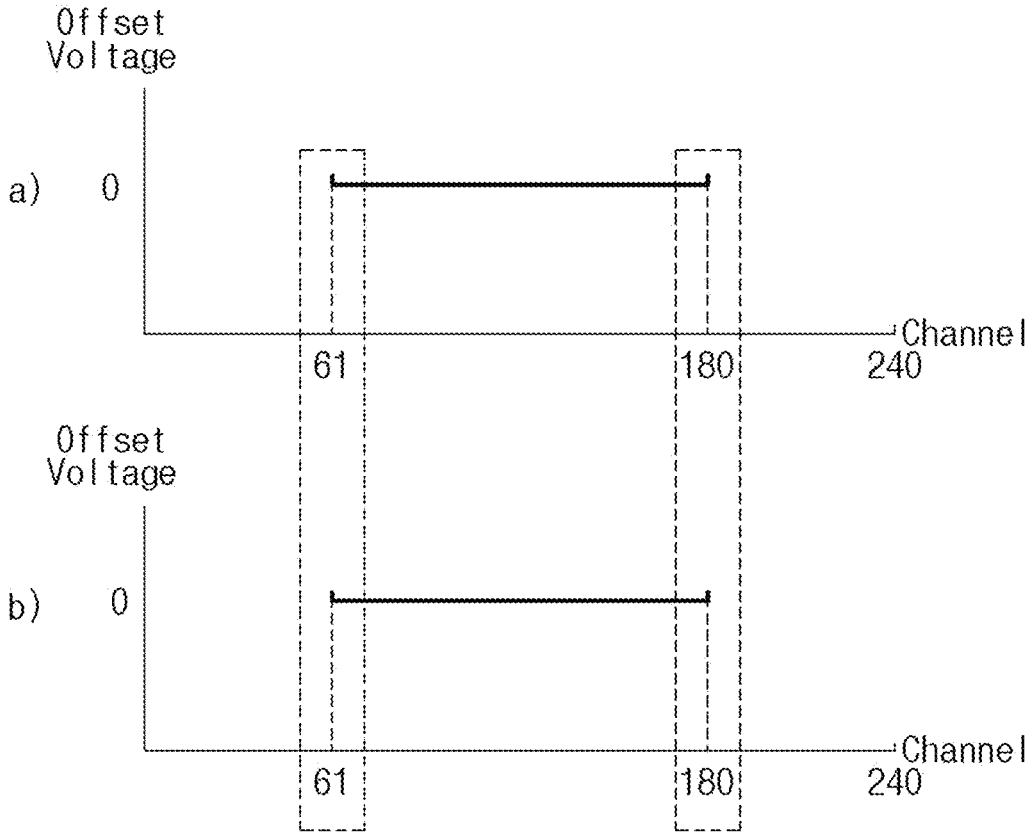
FIG. 7 is of graphs explaining the characteristics of offset values of the voltage sensing circuit in accordance with the embodiment of the present disclosure for the second channel mode.

FIG. 7 is of graphs explaining the characteristics of offset values of the plurality of channel circuits SH61 to SH180 when the dummy channel circuits DM are configured and the display panel 10 and the driver 20 are interfaced to correspond to the second channel mode as illustrated in FIG. 2. In FIG. 7, a) corresponds to the internal compensation, and b) corresponds to the panel compensation.

When the dummy channel circuits DM are configured and the display panel 10 and the driver 20 are interfaced to correspond to the second channel mode as illustrated in FIG. 2, the plurality of channel circuits SH61 to SH180 maintain stable offset values (offset voltages) for the internal compensation as shown in a) of FIG. 7, and maintain stable offset values (offset voltages) for the panel compensation as shown in b) of FIG. 7.

In more detail, in the embodiment of the present disclosure, the dummy channel circuits DM which have electrical coupling relationships with the channel circuits SH61 and SH180 located at both ends of the 120 channel circuits SH61 to SH180 arranged in a line for readout are configured to be adjacent to the channel circuits SH61 and SH180.

The dummy channel circuits DM receive the first reference voltage Vref1 and have a charged voltage corresponding to the first reference voltage Vref1. Therefore, the dummy channel circuits DM act as coupling capacitors which prevent the channel circuits SH61 and SH180 from being influenced by the channel circuits SH60 and SH181 electrically unstable by floating and maintain stable charging voltages in the channel circuits SH61 and SH180.

Thus, the channel circuits SH61 and SH180 may have the same or similar offset values as or to the other channel circuits SH62 to SH179. In other words, the channel circuits SH61 and SH180 do not have substantial differences in performance for compensating for pixel characteristics from the other channel circuits SH62 to SH179.

Hence, in the embodiment of the present disclosure, for the internal compensation and the panel compensation in the first channel mode or the second channel mode, channel circuits which are selected to read out pixel signals may maintain totally uniform and stable offset values (offset voltages). As a result, all the channel circuits SH1 to SH240 may always have uniform pixel characteristic compensation performance regardless of the first channel mode and the second channel mode, and reliability on the compensation of pixel characteristics for display data may be secured.

What is claimed is:

1. A multi-channel voltage sensing circuit for pixel compensation, comprising:

a plurality of channel circuits for multiple channels, the plurality of channel circuits including a first channel circuit, a second channel circuit adjacent to the first channel circuit, a third channel circuit, a fourth channel circuit adjacent to the third channel circuit; and a first dummy channel circuit disposed between the first channel circuit and the second channel circuit and a second dummy channel circuit disposed between the third channel circuit and the fourth channel circuit, wherein the first dummy channel circuit and the second dummy channel circuit receive a first reference voltage of a fixed level, the first dummy channel circuit provides electrical coupling to the first channel circuit and the second channel circuit, and the second dummy channel circuit provides electrical coupling to the third channel circuit and the fourth channel circuit.

2. The multi-channel voltage sensing circuit according to claim 1, wherein each of the first dummy channel circuit and the second dummy channel circuit maintains a charging voltage corresponding to the first reference voltage.

3. The multi-channel voltage sensing circuit according to claim 1, wherein each of the first dummy channel circuit and the second dummy channel circuit acts as a coupling capacitor which is charged in correspondence to the first reference voltage, to provide the electrical coupling.

4. The multi-channel voltage sensing circuit according to claim 1, wherein each of the first dummy channel circuit and the second dummy channel circuit charges a voltage corresponding to a difference between the first reference voltage and a preset internal reference voltage.

5. The multi-channel voltage sensing circuit according to claim 1, wherein each of the first dummy channel circuit and the second dummy channel circuit includes a capacitor circuit having one end to which a preset internal reference voltage is applied and the other end to which the first reference voltage is applied, and the capacitor circuit charges and stores a voltage corresponding to a difference between the first reference voltage and the preset internal reference voltage.

6. The multi-channel voltage sensing circuit according to claim 5, wherein the first reference voltage and the preset internal reference voltage are set to have the same level.

7. The multi-channel voltage sensing circuit according to claim 6, further comprising:

a selection circuit configured to selectively provide a second reference voltage to sensing lines, wherein when the selection circuit is turned on in a first mode, each of the plurality of channel circuits receives the second reference voltage through the sensing line, and outputs a sensing voltage corresponding to a difference between the second reference voltage and the preset internal reference voltage, and wherein when the selection circuit is turned off in a second mode, each of the plurality of channel circuits receives a pixel signal through the sensing line, and outputs the sensing voltage corresponding to a difference between the pixel signal and the preset internal reference voltage.

8. The multi-channel voltage sensing circuit according to claim 7, further comprising:

an amplifier configured to receive and amplify the sensing voltages of the plurality of channel circuits; and an analog-to-digital converter configured to output digital compensation data obtained by analog-to-digital converting an output of the amplifier.

9. The multi-channel voltage sensing circuit according to claim 1, wherein each of the plurality of channel circuits is connected to a sensing line for reading out a pixel signal, and outputs a sensing voltage corresponding to a difference between the pixel signal and a preset internal reference voltage, and each of the first dummy channel circuit and the second dummy channel circuit charges a voltage corresponding to a difference between the first reference voltage and the preset internal reference voltage.

10. The multi-channel voltage sensing circuit according to claim 1, wherein each of the plurality of channel circuits, the first dummy channel circuit and the second dummy channel circuit includes a sample and hold circuit which samples and holds a sensing voltage corresponding to a difference between an input and an internal reference voltage.

11. The multi-channel voltage sensing circuit according to claim 1, wherein the plurality of channel circuits are connected to a display panel through sensing lines for reading out pixel signals.

12. The multi-channel voltage sensing circuit according to claim 1, wherein the plurality of channel circuits arranged in a line for the multiple channels.

13. A multi-channel voltage sensing circuit for pixel compensation, comprising:

a plurality of channel circuits arranged for multiple channels, the plurality of channel circuits including a first channel circuit and a second channel circuit adjacent to the first channel circuit; and a dummy channel circuit disposed between the first channel circuit and the second channel circuit, wherein the dummy channel circuit receives a first reference voltage of a fixed level and provides electrical coupling to the first channel circuit and the second channel circuit.

14. The multi-channel voltage sensing circuit according to claim 13, wherein the dummy channel circuit acts as a coupling capacitor which is charged in correspondence to the first reference voltage, to provide the electrical coupling.

15. The multi-channel voltage sensing circuit according to claim 13, wherein the dummy channel circuit includes a capacitor circuit having one end to which a preset internal reference voltage is applied and the other end to which the first reference voltage is applied, and the capacitor circuit charges and stores a voltage corresponding to a difference between the first reference voltage and the preset internal reference voltage.

16. The multi-channel voltage sensing circuit according to claim 13, wherein each of the plurality of channel circuits is connected to a sensing line for reading out a pixel signal, and outputs a sensing voltage corresponding to a difference between the pixel signal and a preset internal reference voltage, and the dummy channel circuit charges a voltage corresponding to a difference between the first reference voltage and the preset internal reference voltage.

17. The multi-channel voltage sensing circuit according to claim 13, wherein each of the plurality of channel circuits and the dummy channel circuit includes a sample and hold circuit which samples and holds a sensing voltage corresponding to a difference between an input and an internal reference voltage.

18. The multi-channel voltage sensing circuit according to claim 13, wherein the plurality of channel circuits arranged in a line for the multiple channels.

* * * * *